United States Patent [19]

Dresbach

[11] Patent Number: 4,757,704

[45] Date of Patent: Jul. 19, 1988

[54] GUTTER SWEDGE

[76] Inventor: Joseph J. Dresbach, 2479 Nicholson Rd., Sewickley, Pa. 15143

[21] Appl. No.: 850,289

[22] Filed: Apr. 10, 1986

[51] Int. Cl.[4] ..... B21D 3/14

[52] U.S. Cl. ..... 72/393

[58] Field of Search ..... 72/392, 393, 400, 399, 72/454, 60, 61, 465

[56] References Cited

U.S. PATENT DOCUMENTS

| | | | |
|---|---|---|---|
| 1,446,373 | 2/1923 | Böhle | 72/465 |
| 1,567,387 | 12/1925 | Rode | 72/393 |
| 2,066,186 | 12/1936 | Mitchell | 72/400 |
| 2,703,129 | 3/1955 | Smith | 72/454 |
| 2,903,929 | 9/1959 | McVey | 72/399 |
| 2,966,873 | 1/1961 | Hoffman et al. | 72/465 |

FOREIGN PATENT DOCUMENTS

| | | | |
|---|---|---|---|
| 251358 | 8/1969 | U.S.S.R. | 72/392 |
| 733780 | 5/1980 | U.S.S.R. | 72/465 |

*Primary Examiner*—Lowell A. Larson

*Attorney, Agent, or Firm*—Buchanan Ingersoll

[57] ABSTRACT

A C-shaped brace member threadedly receives a screw shaft and supports a channel-shaped die. The lower end of the screw shaft is connected by a ball and socket joint to a pair of hinged pressure plates positioned in parallel relation with the opposite walls of the channel-shaped die. Rotation of the screw shaft in a preselected direction raises and lowers the shaft to extend and retract the pressure plates toward and away from the walls of the base member. An end portion of a gutter section to be expanded is positioned on the base member between the longitudinal edges of the pressure plates and the walls of the base member. Downward movement of the screw shaft moves the pressure plates outwardly toward the walls of the gutter section. The pressure plates contact the walls of the gutter section and bend the walls outwardly to expand the width of the gutter section until further expansion is restrained by the walls of the base member. Rotation of the screw shaft in the opposite direction retracts the pressure plates to permit removal of the expanded gutter section from the base member.

16 Claims, 2 Drawing Sheets

GUTTER SWEDGE

BACKGROUND OF THE INVENTION

1. Field of the Invention

This invention relates to method and apparatus for expanding the width of a channel shaped member, such as a gutter, to permit insertion of an adjacent channel shaped member within the expanded member for connecting adjacent pairs of channel shaped members or gutters.

2. Description of the Prior Art

In the installation of gutters it is common practice to join sections of gutter together by overlapping adjacent end portions of the gutter sections to be connected. Conventionally the gutter sections are overlapped where the end portion of one gutter section extends a distance of approximately two inches into the end portion of an adjacent gutter section. The section which is received within the adjacent section is notched at the top front bead and rear hook edge of the gutter. The notched end portion of one gutter section is advanced into the adjacent gutter section until the end of the receiving gutter section abuts the ends of the notches of the adjacent gutter section. Once the adjacent gutter sections are lapped, they are riveted together along the front, bottom and back sides of the joint. The interior joint and rivet heads are preferably sealed with an adhesive-like material to prevent leakage at the joint.

Preliminary to lapping the gutter sections it is necessary to expand the one gutter section which receives the notched end of the other gutter section. The walls of the receiving gutter section must be spread apart to the extent that the spacing between the interior surfaces of the gutter walls is greater than the spacing between the exterior surfaces of the walls of the notched gutter section. The spacing must be sufficient to permit unobstructed extension of the notched gutter section the required distance into the expanded gutter section so that the end of the expanded section abuts the notches of the opposite gutter section. On the average the length of the extension of the notched gutter section into the expanded gutter section is two inches. Consequently, only a limited portion of the end of the receiving gutter section must be expanded.

It is known to expand the receiving end of a gutter by using conventional pliers and also hammering the walls apart. This practice does not permit controlled and uniform expansion the required length of the gutter section. Frequently, because of improper expansion, the notched section of gutter becomes jammed within the expanded gutter and cannot extend the proper length into the expanded gutter.

While numerous methods are known for expanding metal, none are readily adaptable to the expansion of gutter sections. For example, U.S. Pat. Nos. 1,003,687; 2,252,703 and 2,606,469 disclose devices for expanding metal to remove dents in the metal. Each of these devices utilizes a threaded screw to outwardly expand a pressure plate into compressive relation with the dented surface and conform the dented metal to its original configuration.

Screw actuated spreaders are also known as disclosed in U.S. Pat. Nos. 265,549; 1,675,238 and 2,159,975. These devices are particularly adaptable for expanding a piston wall which has collapsed outwardly from its original diameter. Rotation of a screw in a selected direction expands a spreader outwardly to obtain the desired outward expansion of the piston wall. The degree of the expansion of the piston wall is determined by the range of pivotal movement of links that connect the spreader to the screw.

In the swagging of pipes as disclosed in U.S. Pat. No. 4,220,034 it is known to connect concentric portions of pipe by pivotal movement of a link outwardly into compressive relation with the pipe sections upon rotation of an actuating screw. In U.S. Pat. No. 2,390,553 tapered pails are rotated by a shaft to draw an expander head downwardly to spread camming fingers outwardly against the walls of a workpiece. Devices for forcing under pressure a workpiece into conforming relation with the configuration of a support or die structure are also disclosed in U.S. Pat. Nos. 3,670,555 and 2,401,834.

While it is known to bend, deform or spread a workpiece by a screw actuated, pivotally-mounted spreader there is no suggestion or disclosure in the prior art devices of uniformly spreading a gutter or any other like channel shaped member for connecting in lapping relation an adjacent gutter or channel-shaped member.

Therefore, there is a need for a hand-held device that efficiently expands to a controlled degree a gutter or channel-shaped member to be joined in lapping relation with an adjacent gutter or channel-shaped member.

SUMMARY OF THE INVENTION

In accordance with the present invention there is provided a gutter swedge that includes a brace having an upper end portion and lower end portion. A die member is secured to the brace lower end portion. The die member has a first wall spaced a preselected distance oppositely from a second wall. A pair of plates is positioned in overlying relation with the die member and oppositely of the first and second walls respectively. A hinge connects the pair of plates for pivotal movement toward and away from the first and second walls. Actuator means pivots the pair of plates for movement between an expanded position and a retracted position relative to the first and second walls. The actuator means has an upper end portion connected to the brace upper end portion and a lower end portion connected to the hinge. The actuator means is movable in a preselected direction to apply a force upon the hinge to pivot the pair of plates on the hinge between the expanded and retracted positions.

Further in accordance with the present invention there is provided a mechanism for expanding the width of a channel-shaped member that includes a support member. The support member has an upper end portion and a lower end portion. A base member is positioned on the support member lower end portion for receiving the channel-shaped member having spaced apart walls. Restraining means is positioned on the based member for defining the desired width of expansion of the channel-shaped wall members. An expander is positioned in overlying relation with the base member within the channel-shaped member. The expander has pressure points positioned oppositely of the restraining means for movement toward and away from the restraining means. Actuator means moves the expander to advance and retract the pressure points toward and away from the base member restraining means. The actuator means has an upper end portion and a lower end portion. The actuator means upper end portion is connected for movement relative to the support member upper end portion. The actuator means lower end portion is connected to the expander. The actuator means is movable on the support member in a preselected direction to move the expander and advance the pressure points into contact with the channel-shaped walls being positioned between the pressure points and the restraining means and outwardly expand the channel-shaped member walls into contact with the restraining means to increase the width of the channel-shaped member.

Further in accordance with the present invention there is provided a method for expanding the width of an end portion of a gutter section that includes the steps of positioning the end portion of a gutter section in a channel-shaped die having a preselected width greater than the width of the opposite walls of a gutter section. A pressure applicator is positioned within the gutter section. A downward force is applied upon the pressure applicator to displace the pressure applicator within the gutter section toward the walls thereof. The pressure applicator is advanced outwardly toward both walls of the gutter section. Pressure is applied uniformly outwardly along a selected length of the gutter section walls through the pressure applicator. The walls of the gutter section are expanded simultaneously outwardly upon continued movement of the pressure applicator. The walls of the gutter section expand outwardly until restrained by contact with the channel-shaped die.

Accordingly, the principal object of the present invention is to provide a convenient device for joining adjacent end portions of gutter sections to be installed.

Another object of the present invention is to provide method and apparatus for spreading apart the end portion of a gutter section to receive in overlapping relation an adjacent end portion of a gutter section to join together two gutter sections.

An additional object of the present invention is to provide a mechanism for bending a channel-shaped member, particularly one fabricated of sheet metal, to permit positioning one channel-shaped member in overlapping relation with an adjacently positioned channel-shaped member.

An additional object of the present invention is to provide a hand-held tool operable to bend a sheet metal gutter section to facilitate joining adjacent gutter sections.

These and other objects of the present invention will be more completely disclosed and described in the following specification, the accompanying drawings and the appended claims.

DESCRIPTION OF THE PREFERRED EMBODIMENT

Figure 1:
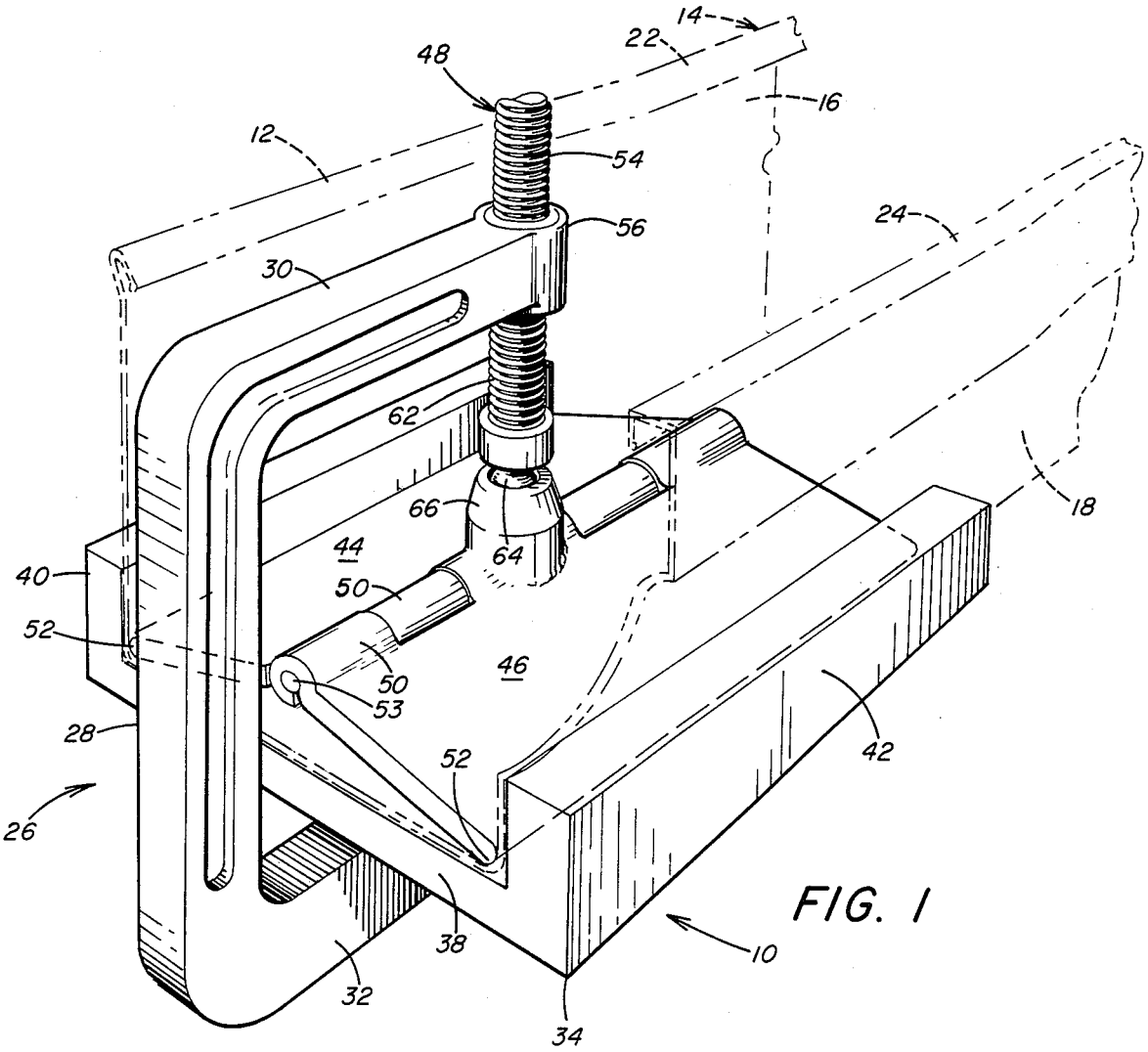
FIG. 1 is a fragmentary isometric view of a gutter swedge, illustrating in phantom an end portion of a gutter section to be expanded in width prior to joining to an adjacent gutter section.
Figure 2:
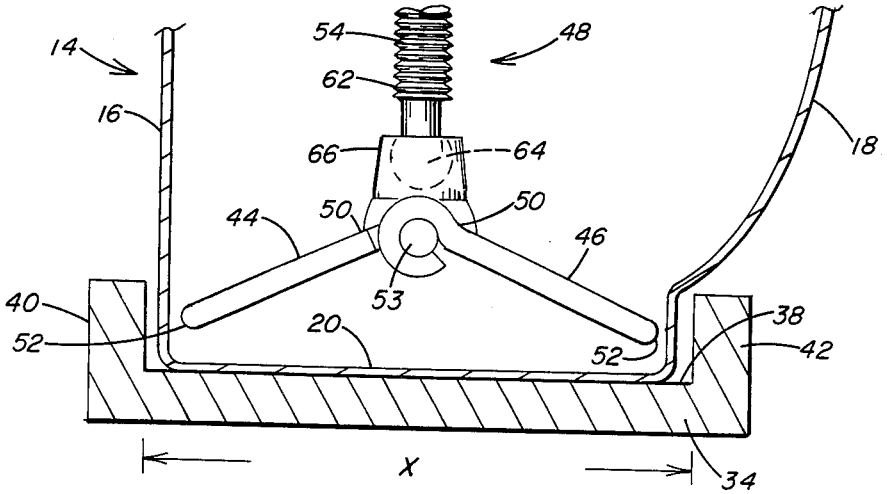
FIG. 2 is a fragmentary sectional view, illustrating the initial positioning of a gutter section in the swedge for expansion.
Figure 3:
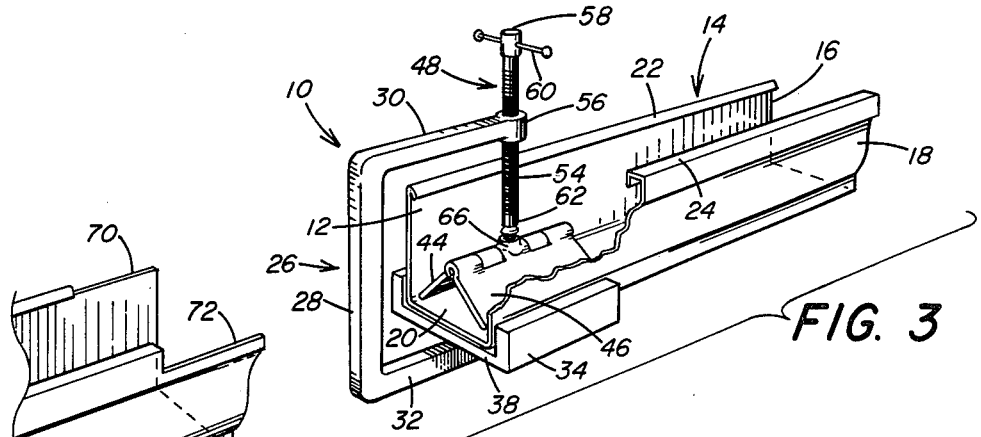
FIGS. 3–6 are schematic isometric views, illustrating the steps of operating the gutter swedge to expand the end portion of a first gutter section for positioning in lapping relation with a second gutter section.
Figure 4:
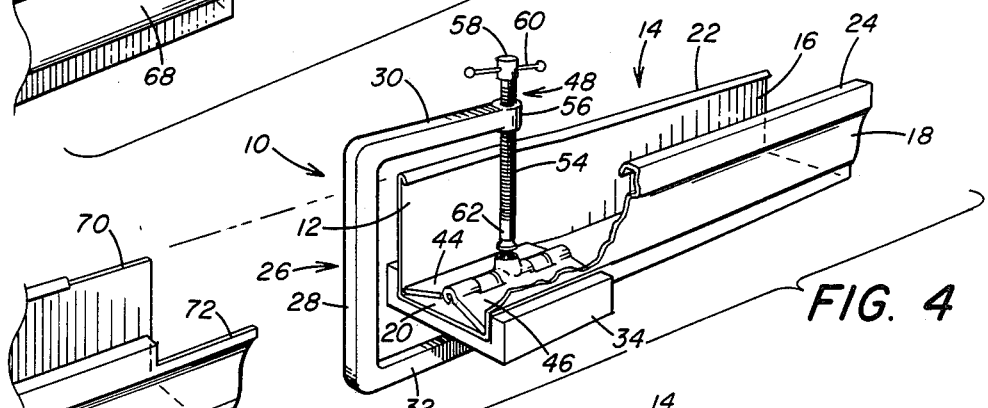
Figure 5:
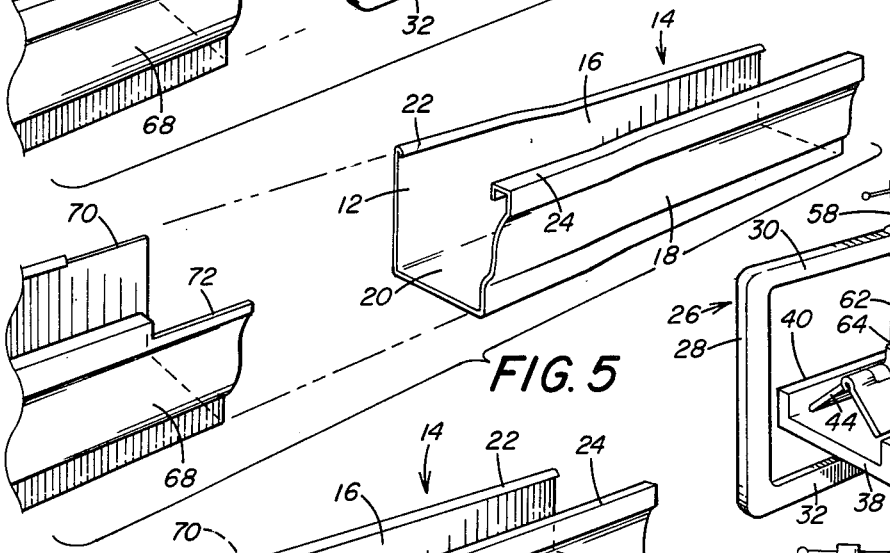

Referring to the drawings and particularly to FIGS. 1, 2, 7 and 8, there is illustrated a mechanism 10 known as a gutter swedge for expanding a channel-shaped member, such as an end portion 12 of a gutter section 14 which is illustrated in greater detail in FIGS. 3–5. It should be understood that the present invention is adaptable for expanding the walls not only of gutter sections but any channel-shaped member having a longitudinal axis.

The gutter section 14 is conventional and includes opposed upstanding sidewalls 16 and 18. The sidewall 16 extends substantially upwardly from an integral trough portion or bottom wall 20. The other sidewall 18 also extends up from and is integral with the bottom wall 20 but preferably extends in an arcuate path upwardly and outwardly from the bottom wall 20.

The gutter section 14 extends upwardly from the bottom wall 20 and terminates in a hook edge 22 that bends inwardly into the gutter channel. Similarly the arcuately shaped sidewall 18 terminates at its upper edge in a front bead 24. The above described gutter configuration is presented only as an example of one type of configuration adaptable for use with the present invention. It should be understood that the present invention is adaptable to any longitudinally extending channel-shaped member having spaced apart deformable sidewalls.

Figure 7:
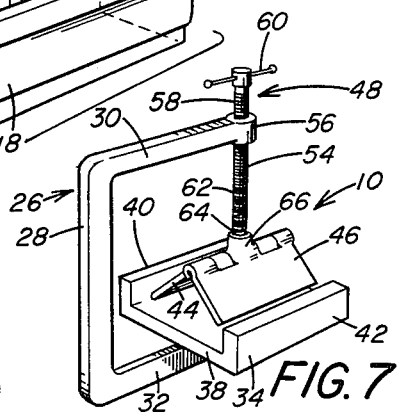
FIG. 7 is an isometric view of the gutter swedge, illustrating the pivotal pressure plates in a retracted position.
Figure 8:
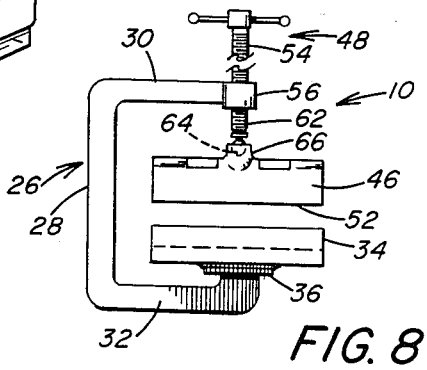
FIG. 8 is a side view of the gutter swedge, illustrating the pressure plates in an elevated position.

As illustrated in FIGS. 7 and 8, the gutter swedge 10 includes a C-clamp shaped brace member generally designated by the numeral 26 formed by a vertical post 28 integrally connected to the overlying horizontal extensions 30 and 32. Extension 30 forms the upper end portion of the brace member 26, and the horizontal extension 32 forms the lower end portion of the brace member 26. A base member 34 is secured by welding, as illustrated in FIG. 8, to a pedestal portion 36 on the outer side of the lower horizontal extension 32.

The base member 34 has a generally channel-shaped configuration corresponding to the configuration of the gutter section 14. The base member 34 includes a bottom wall 38 having a longitudinal axis and a pair of spaced apart sidewalls 40 and 42 extending upwardly from the bottom wall 38. Sidewalls 40 and 42 are positioned between and parallel with the brace extension 30 and 32. The brace post 28 is perpendicularly aligned with the longitudinal axis of the base member 34. With this configuration the base member 34 functions as a die for receiving the channel-shaped gutter section 14 as illustrated in FIGS. 1 and 2.

The base member 34 is formed such that the sidewalls 40 and 42 are spaced a preselected distance "X" (see FIG. 2) apart which exceeds the distance between the gutter sidewalls 16 and 18 at the trough section 20 prior to expansion. With this arrangement the base sidewalls 40 and 42 function as a die to restrain expansion of the gutter section 14 to a desired width.

The gutter section 14, as shown in FIGS. 1 and 2, is expanded by a pair of hinged pressure plates 44 and 46 which are retained by a actuator generally designated by the numeral 48 in overlying relation with the fixed base member 34. Each plate 44 and 46 has a longitudinal extending inner edge 50 and longitudinal extending outer edge 52. The inner edges 50 are rolled in a configuration to form a hinge lock of the plates 44 and 46 to one another. A hinge pin 53 extends through the openings formed by the aligned, rolled edged portions 50. The outer edge portions 52 form the pressure points positioned parallel and oppositely of the respective gutter sidewalls 16 and 18 and base sidewalls 40 and 42.

As will be explained later in greater detail by operation of the hinge connection, the plates 44 and 46 are movable between a retracted position as illustrated in FIGS. 2 and 7 and an extended position as illustrated in FIG. 1. The extension of the plates 44 and 46 results in an increase in the angle formed between the plates 44 and 46. The angle between the plates 44 and 46 increases until the outer edges 52 expand the gutter sidewalls 16 and 18 into contact with the base sidewalls 40 and 42.

In an expanded position as illustrated in FIG. 1 a solid connection is provided along the entire length of the plate edges 52 through the gutter sidewalls 16 and 18 to the base sidewalls 40 and 42. This solid connection permits a uniform application of pressure at all points along the longitudinal length of the plate edges 52. Accordingly, the length of this pressure application is determined by the length of the plate edge portions 52 in contact with the gutter sidewalls 16 and 18.

The pivotal movement of the plates 44 and 46 between an expanded and a retracted position relative to the base member walls 40 and 42 is accomplished by the actuator 48 which includes in one embodiment a threaded screw shaft 54. It should be understood that the actuator 48 can include any mechanism by for moving the plates 44 and 46 between the above retracted and expanded positions.

The brace member 26 at the end of the horizontal extension 30 includes an internally threaded portion 56 adapted to threadedly receive the screw shaft 54. The screw shaft 54 is threaded substantially continuously along the length thereof and includes at an upper end portion 58 a device 60 for generating rotation of the shaft 54 within the threaded portion 56. As illustrated in FIG. 2 the shaft 54 has a lower end 62 that terminates in a ball end portion 64 received within a ball socket 66. The ball socket extends upwardly from and is formed integral with the rolled edged portions 50 of the hingedly connected plates 44 and 46. The hinge pin 53 extends through the rolled edge portions 50 so that the plates 44 and 46 are pivotal on the hinge pin 53.

The engagement of the shaft ball end portion 64 with the socket 66 forms a ball joint connection of the actuator 48 to the hinged plates 44 and 46. With this arrangement the pivotal plates 44 and 46 are not rigidly connected to the shaft end portion 62 but are movable about the longitudinal axis of the shaft 54. This facilitates alignment of the plate outer edge portions 52 in substantial abutting relation with the sidewalls 16 and 18 for expansion of the gutter section 14 to be expanded along the entire length of the plates 44 and 46.

The shaft 54 is rotated within the base member threaded portion 56 in a preselected direction by turning the rotation device 60. Turning the shaft 54 in a first direction to raise the plates 44 and 46 exerts an upward force on the ball socket 66. A separate force is transmitted through the connection of the socket 66 to the plates 44 and 46 so that the plates 44 and 46 pivot about hinge pin 53 toward each other. Continued rotation to raise the shaft 54 in the horizontal extension 30 urges the plates 44 and 46 to retract. Similarly, rotation of the shaft 54 in the opposite direction exerts a downward force on the plates 44 and 46 to expand the plates 44 and 46 outwardly. Thus the plates 44 and 46 are moved to increase the angle between the plates. Rotation of the screw shaft 54 in the opposite direction raises the shaft 54 to retract the plates from the base member sidewalls 40 and 42 and decrease the angle between the plates.

As illustrated in FIG. 8, the threaded shaft 54 can be raised to a point where the hinged plates 44 and 46 are removed from the base member 34. The plates 44 and 46 can be elevated to a position above the base member 34. In this position of the plates 44 and 46 the gutter section 14 can be easily inserted in the base member 34.

The method of expanding the end portion of one gutter section for joining to an adjacent gutter section is illustrated in FIGS. 3–6. Preferably prior to joining the respective gutter end sections, a gutter section 68 to be joined is notched at a hook edge 70 and a front bead 72. The notches extend a preselected length which corresponds substantially to the length of overlap of gutter sections 14 and 68. The length of overlap is selective and generally ranges between about 2 to 3 ½ inches.

In accordance with the method of the present invention the overlap positioning of gutter section 68 within gutter section 14 is accomplished by expanding the gutter section which is to receive the adjacent gutter section by operation of the gutter swedge 10. Preferably with the pressure plates 44 and 46 in an elevated position as shown in FIG. 8 the extreme end portion of the gutter section 14 is advanced into and positioned on the bottom wall 38 of the base member 34. The extent to which the extreme end portion of the gutter section 14 is advanced into the base member 34 is selective.

As illustrated in FIGS. 1 and 3 the extreme end portion of the gutter section 14 can be advanced to a position where the transverse edges of the plates 44 and 46 are in vertical alignment with the outermost edges of the sidewalls 16 and 18 and the trough section 20. In this position the gutter end portion 12 will be expanded the full longitudinal length of the pressure plates 44 and 46. For example, a length of 3 ½ inches. However, if it is desired that only 2 inches of the gutter end portion 12 are expanded the gutter end portion 12 is moved to a position on the base member 34 where only 2 inches of the plate edges 52 overlie the gutter end portion 12.

Once the gutter end portion 12 is inserted in the desired position on the base member 54, the screw shaft 34 is rotated in the desired direction to advance the plate pivot point downwardly so as to increase the angle between the plates 44 and 46. As the screw shaft 54 is rotated the plate edge portions 52 are advanced into contact with the gutter sidewalls 16 and 18. The downward force transmitted upon rotation of the screw shaft 54 is transmitted through the plates 44 and 46 to the gutter sidewalls 16 and 18.

The gutter sidewalls 16 and 18 expand outwardly until further expansion is restrained by contact of the sidewall 16 and 18 with the base member sidewalls 40 and 42. At this point a solid connection is made by contact with the plate edges 52 on one side of the sidewall 16 and 18 and by the base member sidewalls 40 and 42 on the opposite side of the sidewalls 16 and 18.

Once the gutter end portion 12 is expanded the pressure plates 44 and 46 are retracted by rotation of the screw shaft 54 in the opposite direction. The plates 44 and 46 are raised to an elevated position to allow removal of the expanded gutter section 14 from the base member 34. The configuration of the expanded gutter end portion 12 is illustrated in FIG. 5.

Figure 6:
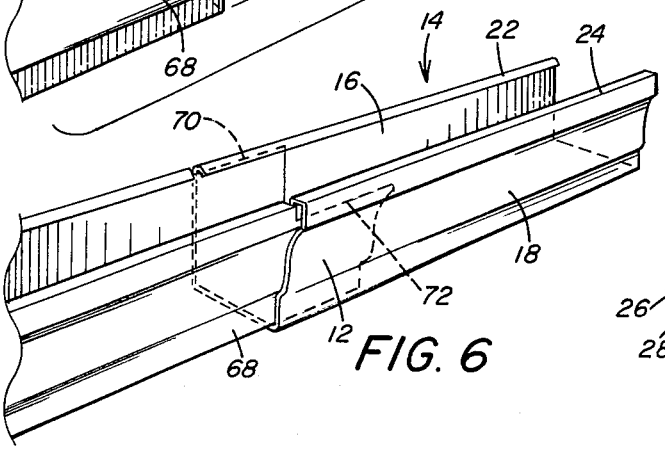

Now referring to FIG. 6, there is illustrated the relative positioning of the expanded gutter section 18 with respect to the adjacent gutter section 68 having the notched portions 70 and 72. With the end portion 12 of gutter section 14 expanded, the distance between the interior surfaces of the gutter walls 16 and 18 is greater than the distance between the exterior surfaces of the adjacent notched gutter section 68. This permits the gutter section 68 to be inserted the length of the notched section into the expanded gutter end portion 12.

As seen in FIG. 6 the gutter section 68 is advanced into the gutter section 14 until the end of the notched sections 70 and 72 abut the extreme ends of the hook edge 22 and the front bead 24 of gutter section 14. Once the adjacent gutter sections are positioned in lapped relation, the conventional steps of fastening the lapped gutter sections can be formed, such as riveting and the applying sealant at the interior joint.

The present invention is readily adaptable for repairing a damaged section of a gutter either at a joint or at any point along the section of a gutter which has been damaged or corroded to a point where leaks have formed in the gutter. The damaged gutter section is cut out and a replacement section having a length exceeding the removed gutter section is selected for installation. To facilitate ease of installation of the replacement gutter section, the exposed ends of the portion of the gutter in place are expanded by operation of the gutter swedge 10 in the above described manner. After the exposed ends of the gutter section that is in place are expanded the ends of the replacement gutter section are notched in a manner as above described for the gutter section 68. The notched replacement gutter section is then placed inside the expanded sections of gutter in place. The replacement gutter section can be notched to a preselected length to control the amount of overlap.

Once the replacement gutter section is positioned within the expanded gutter section, the exposed joints at the ends of the replacement gutter section are secured by riveting and sealed to the adjoining gutter section in place. In the alternative the replacement gutter section can be expanded which requires that the end portions of the gutter section in place must be notched. However, because it is easier to notch the replacement gutter section it is preferred to expand the gutter section that is in place.

According to the provisions of the patent statutes, I have explained the principle, preferred construction and mode of operation of my invention and have illustrated and described what I now consider to represent its best embodiments. However, it should be understood that, within the scope of the appended claims, the invention may be practiced otherwise than as specifically illustrated and described.

I claim:

1. A gutter swedge comprising, a brace having an upper end portion and a lower end portion, a die member secured to said brace lower end portion, said die member having a bottom wall, a first wall and a second wall spaced a preselected disance apart on said bottom wall and extending upwardly from said bottom wall, a pair of plates positioned in overlaying relation with said die member and oppositely of said first and second walls respectively, a hinge conecting said pair of plates for pivotal movement toward and away from said first and second walls, actuator means for pivoting said pair of plates for movement between an expanded position and a retracted position relative to said first and second walls, said actuator means having an upper end portion connected to said brace upper end portion and a lower end portion connected to said hinge, and said actuator means being movable in a first direction to apply a force upon said hinge to simultaneously pivot said pair of plates on said hinge outwardly to an expanded position and a second direction to apply a force upon said hinge to simultaneously pivot said pair of plates on said hinge inwardly to a retracted position.

2. A gutter swedge as set forth in claim 1 which includes, a socket formed integral with and extending upwardly from said hinge, said actuator means lower end portion having a ball-shaped configuration, and said actuator means lower end portion positioned in said socket to form a ball joint connection of said actuator means to said pair of plates.

3. A gutter swedge as set forth in claim 1 which includes, said actuator means being threadedly connected to said brace upper end portion, and said actuator means rotatable in a preselected direction to expand and retract said pair of plates to move said pair of plates toward and away from said die member first and second walls.

4. A gutter swedge as set forth in claim 1 in which, said brace has a C-shaped configuration formed by a vertical post integrally connected to an upper extension from said brace upper end portion and a lower extension extending from said brace lower end portion, said die member having a channel-shaped configuration with a longitudinal axis, said brace lower horizontal extension being aligned with said longitudinal axis and secured to said die member, and said brace including a vertical post perpendicularly aligned with said longitudinal axis so that said die member first and second walls are positioned between and in parallel alignment with said brace upper and lower horizontal extensions.

5. A gutter swedge as set forth in claim 1 in which, said pair of plates each includes an outer edge portion positionable parallel and oppositely of said die member first and second walls to uniformly apply pressure along the entire length of said plates against said die member first and second walls.

6. A mechanism for expanding the width of a channel-shaped member comprising, a support member, said support member having an upper end portion and a lower end portion, a base member positioned on said support lower end portion for receiving a channel-shaped member having spaced apart walls, restraining means positioned on said base member for defining the desired width of expansion of the channel-shaped member walls, an expander positioned in overlying relation with said base member within the channel-shaped member, said expander having a pair of pivotal portions with pressure points positioned oppositely of said restraining means for movement toward and away from said restraining means, actuator means for pivoting said expander pivotal portions to advance and retract said pressure points toward and away from said base member restraining means, said actuator means having an upper end portion and a lower end portion, said actuator means upper end portion being connected for movement relative to said support member upper end portion, said actuator means lower end portion being connected to said expander pivotal portions, said actuator means being movable on said support member in a preselected direction to downwardly move said expander to initiate pivotal movement of siad expander pivotal portions and advance said pressure points into contact with the channel-shaped member walls being positioned between said pressure points and said restraining means, and said actuator means continued movement in said preselected direction increasing the angle between said pair of expander pivotal portions to outwardly expand the channel-shaped member walls into contact with said restraining means to increase the width between the walls of the channel-shaped member.

7. A mechanism as set forth in claim 6 which includes, means for connecting said actuator means lower end portion to said expander to maintain alignment of said expander pressure points with the channel-shaped member walls for outward expansion of the walls the entire length of said expander.

8. A mechanism as set forth in claim 6 which includes, means for rotatably supporting said actuator on said support member upper end portion so that rotation of said actuator in a preselected direction initiates movement of said expander pressure points toward and away from said restraining means.

9. A mechanism as set forth in claim 6 which includes, means for pivotally connecting said actuator means to said expander to allow movement of said expander relative to said actuator so that said expander pressure points uniformly apply pressure upon the channel-shaped member walls.

10. A mechanism as set forth in claim 6 which includes, said expander having a first portion and a second portion, said first and second portions being hingedly connected, said actuator means lower end portion being secured to the hinged connection of said first and second portions, and said actuator means being movable to initiate pivotal movement of said first and second portions about the hinged connection for movement of said pressure points into and out of compressure relation with the channel shaped wall members.

11. A mechanism as set forth in claim 6 which includes, a ball and socket connection of said actuator means to said expander to permit relative movement between said expander and said actuator means as said pressure points move into contact with the channel-shaped member walls for uniform application of pressure along the length of said expander upon the channel-shaped member walls

12. A method for expanding the width of an end portion of a gutter section comprising the steps of, positioning the end portion of a gutter section in a channel-shaped die having a preselected width greater than the width between opposite walls of the gutter section, positioning a pivotal pressure applicator within the gutter section, applying a downward force upon the pressure applicator to downwardly move the pressure applicator within the gutter section toward the walls thereof, pivoting portions of the pressure applicator outwardly toward both walls of the gutter section upon continued downward movement of the pressure applicator, increasing the angle between the pivoting portions of the pressure applicator to apply pressure outwardly along a selective length of the gutter walls through the pressure applicator, and simultaneously expanding the walls of the gutter section outwardly upon continued outward pivotal movement of the pressure applicator until the gutter section walls are restrained by contact with the channel-shaped die.

13. A method as set forth in claim 12 which includes, generating rotary motion to initiate displacement of the pressure applicator, and converting the rotary motion to outward linear movement of the pressure applicator into compressive relation with the walls of the gutter section.

14. A method as set forth in claim 12 which includes, supporting the pressure applicator within the gutter section for movement into compressive relation with the walls of the gutter section along the entire length of the pressure applicator.

15. A method as set forth in claim 12 which includes, supporting the gutter section in the channel-shaped die having the desired configuration of the expanded gutter section, positioning the gutter section in a preselected position in the channel-shaped die for expansion of the gutter section walls along a preselected length of the gutter section, and advancing the pressure applicator into compressive relation with the gutter section walls to urge the gutter section walls into abutting relation with the channel-shaped die and expand the gutter section walls along a preselected length of the gutter section.

16. A method as set forth in claim 12 which includes, maintaining longitudinal edges of the pressure applicator in substantial parallel alignment with the walls of the gutter section as the pressure applicator is advanced into compressive relation with the walls of the gutter section to uniformly expand the walls along a selected length of the gutter section.

* * * * *